United States Patent [19]

Fourezon

[11] Patent Number: 4,696,853

[45] Date of Patent: Sep. 29, 1987

[54] TEXTILE REINFORCEMENT ADAPTED TO BE USED FOR MAKING LAMINATED COMPLEXES AND PROCESS FOR OBTAINING SAME

[75] Inventor: André Fourezon, Le Cheylard, France

[73] Assignee: Establissements les Fils d'Auguste Chomarat & Cie, France

[21] Appl. No.: 829,108

[22] Filed: Feb. 14, 1986

[30] Foreign Application Priority Data

Feb. 22, 1985 [FR] France ..... 85 02784

[51] Int. Cl.[4] ..... B32B 7/00

[52] U.S. Cl. ..... 428/257; 156/148; 156/229; 156/494

[58] Field of Search ..... 428/105, 218, 224, 257, 428/258, 259, 296, 113; 156/148, 229, 494

[56] References Cited

U.S. PATENT DOCUMENTS

| | | | |
|---|---|---|---|
| 2,879,581 | 3/1959 | Evans et al. | 428/257 |
| 3,832,210 | 8/1974 | Rohlfing | 428/257 |
| 4,055,697 | 10/1977 | Schmanski . | |
| 4,097,631 | 6/1978 | Wilken | 428/257 |
| 4,299,878 | 11/1981 | Rheaume | 428/257 |
| 4,416,929 | 11/1983 | Krueger | 428/102 |
| 4,438,173 | 3/1984 | Trost | 428/257 |
| 4,440,819 | 4/1984 | Rosses et al. | 428/257 |
| 4,590,121 | 5/1986 | Mohr | 428/257 |

FOREIGN PATENT DOCUMENTS

| | | |
|---|---|---|
| 169245 | 11/1904 | Fed. Rep. of Germany . |
| 1502610 | 11/1967 | France . |
| 2425487 | 7/1979 | France . |
| 2500495 | 8/1982 | France . |

*Primary Examiner*—James J. Bell

*Attorney, Agent, or Firm*—Parkhurst and Oliff

[57] ABSTRACT

This invention relates to a textile reinforcement process for making laminated complexes, of the type constituted for the major part by fibers extending transversely with respect to the length of said reinforcement, said yarns being joined together by a loose binding warp, wherein:

the transverse yarns are disposed on a bias with respect to the length of the binding warp, and said binding warp is based on yarns which are at least superficially thermo-fusible.

6 Claims, 3 Drawing Figures

TEXTILE REINFORCEMENT ADAPTED TO BE USED FOR MAKING LAMINATED COMPLEXES AND PROCESS FOR OBTAINING SAME

BACKGROUND AND SUMMARY OF THE INVENTION

The present invention relates to a novel type of textile reinforcement, based on glass filaments in particular, adapted to be used for making laminated complexes. It also relates to a process for obtaining such a type of reinforcement.

Among the textile materials used for making laminated articles, i.e. articles based on a resin (polyester or other) reinforced by a textile structure, it has been proposed to produce a type of textile reinforcement so-called "unidirectional" layers primarily consisting of fibers (for example glass filaments) extending transversely with respect to the length of the layers, said filaments being bound together by a loose binding warp which maintains the filling yarns parallel to one another.

When making the laminated article, a plurality of layers produced in this way are superposed, offsetting them, for example, by 90° with respect to one another in order to have good mechanical characteristics both lengthwise and widthwise.

It has also been proposed to use textile reinforcements in which the cross yarns are disposed on a bias with respect to the length, such articles being constituted not by a veritable weave but by a "grid", i.e. a structure composed of superposed layers of yarns, oriented differently from one another and bonded together by adhesion. Such articles of the "grid" type make it possible to obtain laminated materials reinforced in all directions, but they present the drawback of comprising a large quantity of binding agents which may be detrimental to the qualities of the finished composite article.

Now, a novel type of unidirectional woven textile material has been found, and forms the subject matter of the present invention, which not only presents the advantages of such woven articles, i.e. a good holding of the yarns with respect to one another, but also offers the possibility, as in the case of the non-woven textile grids, of obtaining unidirectional articles in which the majority yarns extend on a bias with respect to the binding warp yarns, forming any angle with respect to said yarns.

The invention generally relates to a novel type of textile reinforcement adapted to be used for making laminated articles, this reinforcement being of the type constituted for the major part by fibers extending transversely with respect to the length of the layer, said yarns being joined together by a loose binding warp, and is characterized in that:

the transverse yarns are disposed on a bias with respect to the length of the binding warp, and said binding warp is based on yarns which are at least superficially thermo-fusible.

The material constituting the cross yarns will be composed of any type of conventional material for making laminated articles (such as glass fibers, carbon fibers, aramid fibers such as those marketed under the trademark "KEVLAR").

Furthermore, the fusible yarns for making the binding warp will be constituted by any material compatible with the resins to be reinforced. A yarn based on copolyamide may, for example, be used (such as those marketed under the trademark "GRILON") for which the zone of fusion lies between 70° and 150° C., these yarns being either multifilaments or monofilaments. Core spun yarns may also be used, comprising a core based on a material similar to those of the warp yarn (for example glass, aramid, carbon, . . . ), coated with a layer of thermo-fusible material such as a layer of polyamide or polyester.

When making the laminated article, the layers according to the invention may be superposed, orienting the cross yarns differently from one layer to the other, which makes it possible to obtain reinforcement in all directions. During such a superposition, the presence of the thermo-fusible binding yarns further promotes the bond between the different layers. The different superposed layers may possibly be combined with other textile materials such as non-woven fibrous layers, the stack thus formed being able to be joined by stitching, knitting, etc.

The present invention also relates to a process for obtaining such textile reinforcement, said process consisting of weaving an article comprising filling yarns bound to one another with woven warp yarns which are loose with respect to the density of the filling yarns, being characterized in that, after having made said fabric, the orientation of the filling yarns with respect to the warp yarns is modified and, at the same time, a heat treatment is effected, provoking the superficial fusion of the binding warp yarns.

The displacement of the orientation of the filling yarns with respect to the warp yarns may be obtained by any known means, for example by means of a tentering machine in which the lateral holding elements have a displacement offset with respect to each other.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENT

Figure 1:
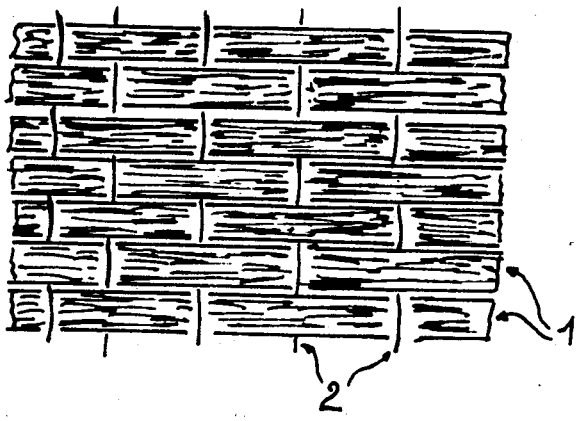
FIG. 1 schematically illustrates a unidirectional layer leaving the weaving loom.

Referring now to the drawings, the material according to the invention is constituted by a dense layer of filling yarns 1 joined together by woven warp yarns 2 which are loose with respect to the density of the filling yarns 1. On leaving the loom, the article is in the form illustrated in FIG. 1, i.e. the filling yarns 1 and the warp yarns 2 are perpendicular to one another.

Figure 2:
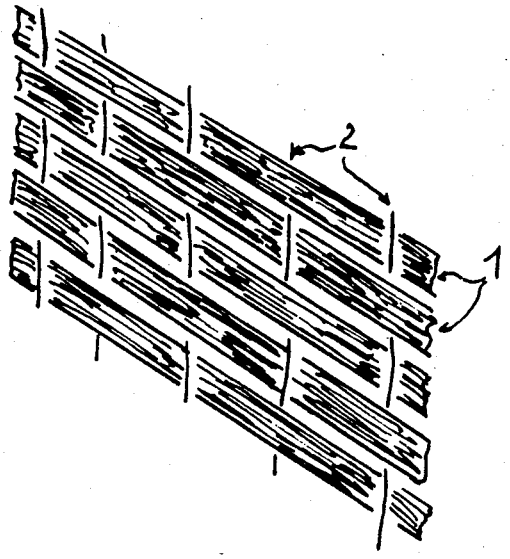
FIG. 2 illustrates the structure of the layer according to a modification of the orientation of the filling yarns with respect to the warp yarns.

According to the invention, after such a weave has been made, it is subjected to a treatment with a view to modifying the orientation of the filling yarns 1 with respect to the warp yarns, as shown in FIG. 2. Such a modification of the orientation of the filling yarn 1 with respect to the warp yarn 2 is obtained for example by passing the formed weave on a conventional tentering machine.

According to the invention, the warp yarns 2 are yarns which are at least superficially thermo-fusible, with the result that, upon deformation, the fusion of said warp yarns and consequently the blocking of the filling yarns 1 in the new position communicated thereto, are provoked.

Figure 3:
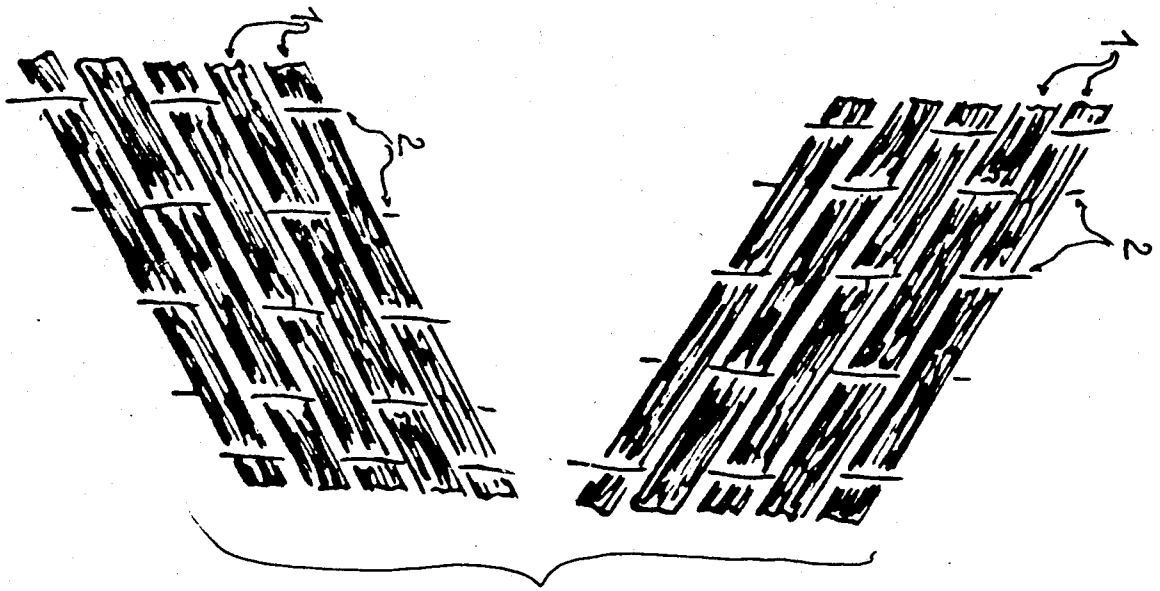
FIG. 3 illustrates the manner in which different layers may be superposed when making a laminate proper.

The unidirectional layers thus formed, in which the inclination of the filling yarns 1 with respect to the warp yarns 2 may be any angle but is generally about 45°, may be superposed, as shown in FIG. 3, with the result that the filling yarns 1 are oriented differently from one layer to another. The different layers may possibly be associated with other textile materials, such as for example a layer of glass fibers, the bond being obtained by any known means such as adhesion, knitting or stitching.

It has been ascertained that the presence of the thermo-fusible warp yarns makes it possible not only to ensure perfect holding of the filling yarns 1 in the desired orientation, but also during superposition of several layers and heat treatments. A good bond is obtained between the different reinforcing layers.

The invention is, of course, not limited to the embodiment given hereinbefore, but it covers all the variant embodiments made in the same spirit. For example, the filling yarns 1 may possibly be associated with additional parallel thermo-fusible yarns or embedded within said filling yarns 1.

Such a material may also be used in applications other than the reinforcement of resin, for example as support for bitumen or various coatings.

What is claimed is:

1. A textile reinforcement adapted to be used for making laminated complexes, comprising:

filling yarns extending transversely with respect to the length of said reinforcement;

a loose binding warp interwoven with said filling yarns, the density of said binding warp being less than the density of said filling yarns, said filling yarns being disposed on a bias with respect to said binding warp, said binding warp comprising yarns which are superficially thermally fused to said filling yarns, thereby maintaining said bias.

2. The textile reinforcement of claim 1, wherein said binding warp comprises filaments coated with a thermo-fusible material such as glass fibers coated with polyamide.

3. The textile reinforcement of claim 1, wherein said binding warp comprises thermo-fusible synthetic filaments such as those based on copolyamide.

4. A laminated article comprising a plurality of superposed layers of the textile reinforcement according to claim 1, wherein the orientation of said filling yarns differs from one layer to another.

5. A process for producing the textile reinforcement of claim 1, consisting of weaving an article comprising filling yarns bound to one another by said binding warp yarns, the density of which is less than the density of said filling yarns, the orientation of said filling yarns being biased with respect to said binding warp and, at the same time, effecting a heat treatment, thereby superficially fusing said binding warp yarns with said filling yarns.

6. The process of claim 5, wherein the biasing of the orientation of the filling yarn with respect to the warp yarn is obtained by means of a tentering machine in which lateral holding elements have a displacement offset with respect to each other.

* * * * *